US007653959B1

(12) United States Patent
Catanzaro

(10) Patent No.: US 7,653,959 B1
(45) Date of Patent: Feb. 2, 2010

(54) ARTICLE ASSEMBLY

(76) Inventor: David Catanzaro, 626 Penn Ave., Mayfield, PA (US) 18433

( * ) Notice: Subject to any disclaimer, the term of this patent is extended or adjusted under 35 U.S.C. 154(b) by 0 days.

(21) Appl. No.: 09/505,791

(22) Filed: Feb. 17, 2000

Related U.S. Application Data

(63) Continuation of application No. 08/777,032, filed on Dec. 30, 1996, now Pat. No. 6,026,532.

(51) Int. Cl.
*A46B 9/04* (2006.01)

(52) U.S. Cl. ..... 15/167.1; 15/184; 15/143.1; 15/257.01; D4/108; D4/107; D6/534; 248/111; 248/908; 132/308

(58) Field of Classification Search ..... D4/104, D4/107, 108, 125, 126; D6/528, 534; 15/167.1, 15/143.1, 184, 257.01, 146, 246; 248/163.1, 248/188.8, 188.9, 110, 111, 915, 908; 132/308, 132/309; 206/362.3, 349, 457
See application file for complete search history.

(56) References Cited

U.S. PATENT DOCUMENTS

D155,668 S * 10/1949 Zandberg et al. ..... D4/107
2,539,035 A * 1/1951 Scanlon et al. ..... 248/111
D197,309 S * 1/1964 Feverbacher ..... D4/107
3,138,813 A * 6/1964 Kaplan ..... 15/22
3,140,782 A * 7/1964 Schulte ..... 248/908
D209,574 S * 12/1967 Zandberg et al. ..... D4/107
D279,248 S * 6/1985 Oliver ..... D6/104
5,269,420 A * 12/1993 Harrison et al. ..... 206/362.3
5,353,464 A * 10/1994 Atkins et al. ..... 15/167.1
5,444,889 A * 8/1995 Barre ..... 15/167.1
D363,166 S * 10/1995 Perrine ..... D4/104
D369,932 S * 5/1996 Petronio ..... D6/534
D370,146 S * 5/1996 Petronio ..... D6/534
D370,147 S * 5/1996 Petronio ..... D6/534
5,590,436 A * 1/1997 Wright ..... 15/105
5,675,859 A * 10/1997 Barre ..... 15/167.1
D388,254 S * 12/1997 Schiffer ..... D4/107
D392,464 S * 3/1998 Jesiolowski ..... D4/107
D395,757 S * 7/1998 Schiffer ..... D4/107
6,015,328 A * 1/2000 Glaser ..... 15/167.1
6,026,532 A * 2/2000 Catanzaro ..... 15/167.1
6,141,815 A * 11/2000 Harrison et al. ..... 15/145

OTHER PUBLICATIONS

Pictures of SALTON Inc. foot stand, stand includes a copyright mark of 1990.*
Pictures of SALTON Inc. foot stand, stand was on sale in Mar. 1999.*

* cited by examiner

*Primary Examiner*—Gary K. Graham

(57) ABSTRACT

An assembly comprising a toothbrush having a first and second end. A stand in the shape of a pair of feet retains the brush in a vertical position when the stand is placed on a horizontal surface. For additional support, a base may be incorporated with the stand.

8 Claims, 2 Drawing Sheets

ARTICLE ASSEMBLY

This application is a continuation of U.S. Utility Application 08/777,032, filed on Dec. 30, 1996, now U.S. Pat. No. 6,026,532. The earlier filing date of this application is hereby claimed under 35 U.S.C 120.

BACKGROUND OF THE INVENTION

1. Field of the Invention

This application claim benefit to provisional Application 60/009,323 Dec. 28, 1995.

The instant invention relates generally to toothbrushes, but may also find a useful application in other types of methods differing from the type described herein. More specifically it relates to an assembly which may contain a combination of appealing qualities.

2. Description of the Prior Art

There are various advantages in storing a toothbrush in an upright position, and numerous patents have disclosed holders or stands for retaining a toothbrush in a vertical position when placed on a horizontal surface. For instance, U.S. Pat. No. 5,444,889 (Barre) discloses a toothbrush assembly including a toothbrush and a stand for holding the brush. The stand includes a cup portion having a cavity within, wherein the brush handle can be inserted. A pair of legs separate and unattached to one another support and are connected to the cup portion. Further included is a foot for each leg, each foot being connected to the lower end of the leg opposite the cup portion. The feet are also separate and unattached from one another. U.S. Pat. Des. 369,932 and U.S. Pat. Des. 370,147 (Petronio) discloses a toothbrush holder in the shape of a torso having a front and rear portion. The front portion includes a recess extending therethrough, wherein a brush handle can be inserted, Further included, extending from the front portion, is a pair of feet which are separate and unattached from one another. A tail section extends from the rear portion. While these units may be suitable for the particular purpose to which they address, they would not be suitable for the purposes of the present invention as heretofore described.

SUMMARY OF THE INVENTION

A first object of the present invention is to provide an assembly that will overcome the shortcomings of the prior art devices.

A second object is to provide an assembly, comprising a toothbrush having a first and second end, and a stand for receiving the second end of the brush handle therein, thereby retaining the handle in a vertical position when the stand is placed on a horizontal surface.

A third object is to provide an assembly, in which the stand is releasably connected to the toothbrush handle.

A forth object is to provide an assembly, in which the stand is a pair of feet which are positioned together to form a continuous bottom supporting surface and a single heel portion, wherein the single heel portion includes a recess for selectively receiving the second end of the toothbrush handle therein.

A fifth object is to provide an article assembly, in which a base is connected to the bottom side of the foot stand for providing additional stability to the foot stand.

A sixth object is to provide an article assembly, in which the base includes a recess extending therethrough and in alignment with the recess in the foot stand for additionally receiving the receivable end of the article therein, for providing additional stability to the foot stand and article.

A seventh object is to provide an article assembly, that is simple and easy to use.

An eight object is to provide an article assembly, that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
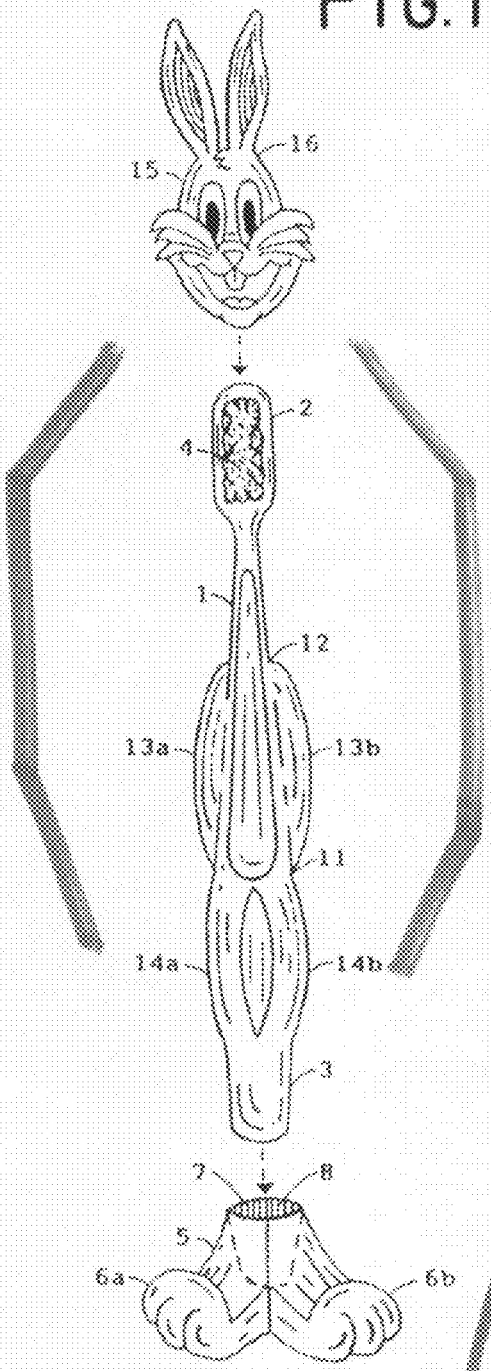
FIG. 1 is a front exploded perspective view of the assembly according to the present invention.
Figure 2:
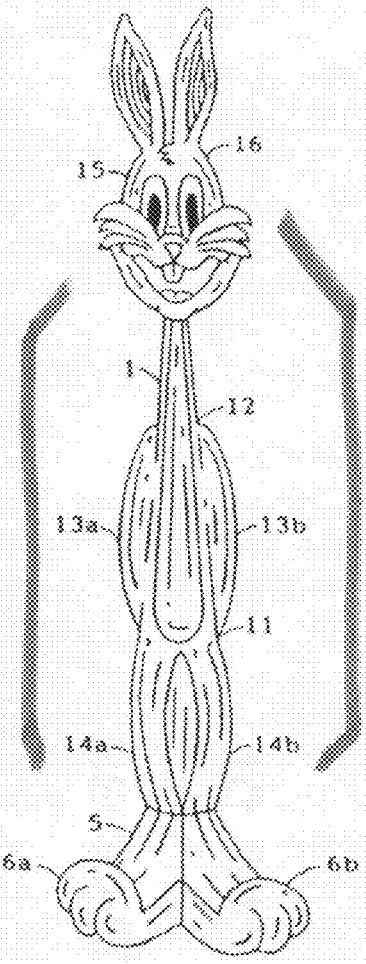
FIG. 2 is a front exploded perspective view of the assembly according to the present invention showing a base for the stand.
Figure 3:
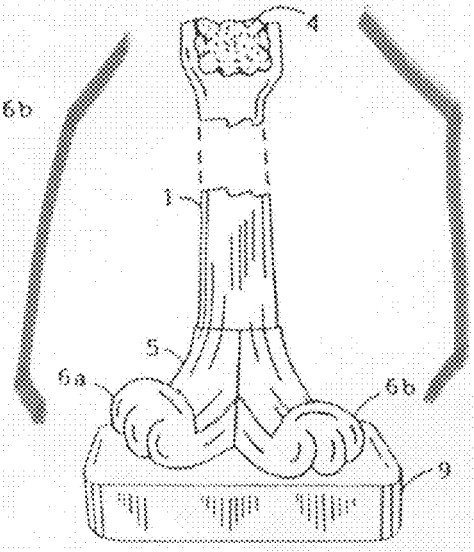
Figure 4:
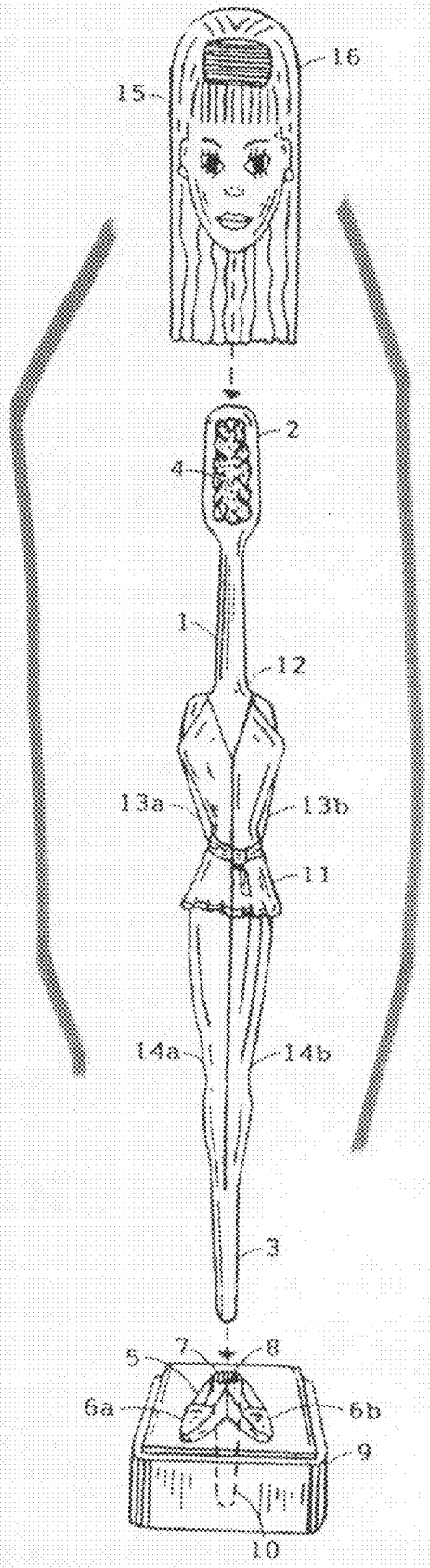
Figure 5:
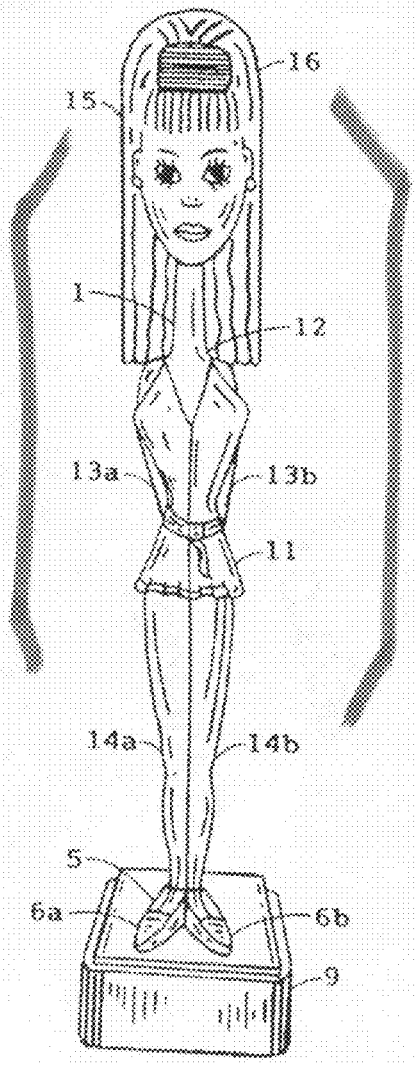
Figure 1:
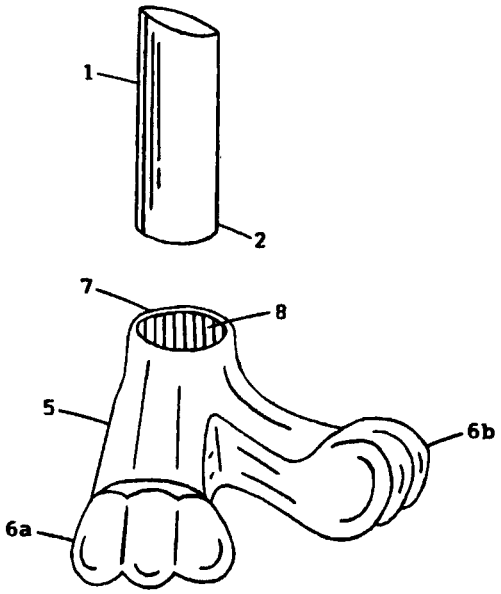
Figure 2:
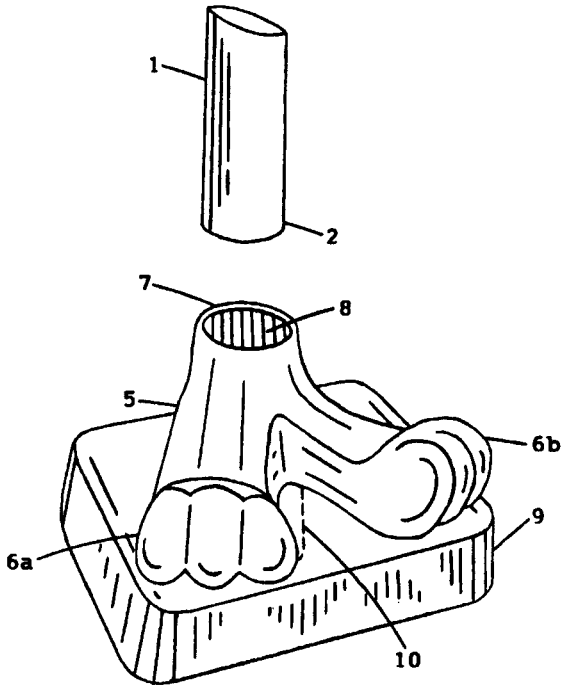

With regard to FIGS. 1 and 2, the embodiment of the invention drawn shows an elongated handle 1 having a first end 2 a second end 3 and a first and second side. A stand 5 is in the shape of first and second feet 6*a* and 6*b*. Each first and second feet 6*a* and 6*b*, are elongated to define a toe end and together a common heel end. First and second feet 6*a* and 6*b* are joined together and positioned together to form a continuous bottom supporting surface. The heel end of each first and second feet 6*a* and 6*b*, is positioned together to form a single heel portion 7. Single heel portion 7 includes a recess 8 extending through a top side thereof and towards a sole thereof for selectively receiving second end 3 of handle 1 therein, thereby retaining handle 1 in a vertical position when stand 5 is placed on a horizontal surface. First and second feet 6*a* and 6*b* each include a side surface, the side surfaces intersect one another in a common plane. The toe end of first and second feet 6*a* and 6*b* are at an acute angle to one another.

If desired, a base 9 could be connected to a bottom side of stand 5 as shown in FIG. 2. Base 9 may include a recess 10 extending therethrough and in alignment with recess 8 in stand 5 for additionally receiving second end 3 of handle 1 therein, to provide additional stability to handle 1 and stand 5.

It will be understood that each of the elements described above, or two together, may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the sprit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic aspects of this invention.

What is claimed is new and desired to be protected by Letters Patent is set forth in the appended claims:

1. An article assembly comprising:

a) an article having a receivable end, and b) a stand in the shape of first and second feet, each of said first and second feet being elongated to define a toe end and together a common heel end, said first and second feet being joined together and positioned together to form a continuous bottom supporting surface, said heel end of each of said first and second feet being positioned together to form a single heel portion, said single heel portion including a recess extending through a topside thereof and towards a sole thereof for selectively receiving said receivable end of said article therein, thereby retaining said article when said stand is placed on a horizontal surface, said first and second feet each including a side surface, said side surfaces intersecting one another in a common plane.

2. The article assembly as claimed in claim 1, further comprising a base connected to a bottom side of said stand.

3. The article assembly as claimed in claim 2, wherein said base includes a recess extending therethrough and in alignment with said recess in said stand for additionally receiving said receivable end of said article therein.

4. The article assembly as claimed in claim 1, wherein said toe end of said first and second feet are at an acute angle to one another.

5. An article assembly comprising:

A stand in the shape of first and second feet, each of said first and second feet being elongated to define a toe end and together a common heel end, said first and second feet being joined together and positioned together to form a continuous bottom supporting surface, said heel end of each of said first and second feet being positioned together to form a single heel portion, said single heel portion including a recess extending through a topside thereof and towards a sole thereof, said first and second feet including a side surface, said side surfaces intersecting one another in a common plane.

6. The article assembly as claimed in claim 5, further comprising a base connected to a bottom side of said stand.

7. The article assembly as claimed in claim 6, wherein said base includes a recess extending therethrough and in alignment with said recess in said stand.

8. The article assembly as claimed in claim 5, wherein said toe end of said first and second feet are at an acute angle to one another.

* * * * *

UNITED STATES PATENT AND TRADEMARK OFFICE

CERTIFICATE OF CORRECTION

PATENT NO. : 7,653,959 B1
APPLICATION NO. : 09/505791
DATED : February 2, 2010
INVENTOR(S) : Catanzaro It is certified that error appears in the above-identified patent and that said Letters Patent is hereby corrected as shown below:

The title page, showing an illustrative figure, should be deleted and substitute therefor the attached title page.

Delete drawing sheets 1-2 and substitute therefor the drawing sheet, consisting of figures 1-2 as shown on the attached page.

Signed and Sealed this

Eighteenth Day of May, 2010

David J. Kappos

David J. Kappos
*Director of the United States Patent and Trademark Office*

(12) United States Patent
Catanzaro

(10) Patent No.: US 7,653,959 B1
(45) Date of Patent: Feb. 2, 2010

(54) ARTICLE ASSEMBLY

(76) Inventor: David Catanzaro, 626 Penn Ave., Mayfield, PA (US) 18433

( * ) Notice: Subject to any disclaimer, the term of this patent is extended or adjusted under 35 U.S.C. 154(b) by 0 days.

(21) Appl. No.: 09/505,791

(22) Filed: Feb. 17, 2000

Related U.S. Application Data

(63) Continuation of application No. 08/777,032, filed on Dec. 30, 1996, now Pat. No. 6,026,532.

(51) Int. Cl.
*A46B 9/04* (2006.01)

(52) U.S. Cl. ..... 15/167.1; 15/184; 15/143.1; 15/257.01; D4/108; D4/107; D6/534; 248/111; 248/908; 132/308

(58) Field of Classification Search ..... D4/104, D4/107, 108, 125, 126; D6/528, 534; 15/167.1, 15/143.1, 184, 257.01, 146, 246; 248/163.1, 248/188.8, 188.9, 110, 111, 915, 908; 132/308, 132/309; 206/362.3, 349, 457
See application file for complete search history.

(56) References Cited

U.S. PATENT DOCUMENTS

D155,668 S * 10/1949 Zandberg et al. ..... D4/107
2,539,035 A * 1/1951 Scanlon et al. ..... 248/111
D197,309 S * 1/1964 Feverbacher ..... D4/107
3,138,813 A * 6/1964 Kaplan ..... 15/22
3,140,782 A * 7/1964 Schulte ..... 248/908
D209,574 S * 12/1967 Zandberg et al. ..... D4/107
D279,248 S * 6/1985 Oliver ..... D6/104
5,269,420 A * 12/1993 Harrison et al. ..... 206/362.3
5,353,464 A * 10/1994 Atkins et al. ..... 15/167.1
5,444,889 A * 8/1995 Barre ..... 15/167.1
D363,166 S * 10/1995 Perrine ..... D4/104
D369,932 S * 5/1996 Petronio ..... D6/534
D370,146 S * 5/1996 Petronio ..... D6/534
D370,147 S * 5/1996 Petronio ..... D6/534
5,590,436 A * 1/1997 Wright ..... 15/105
5,675,859 A * 10/1997 Barre ..... 15/167.1
D388,254 S * 12/1997 Schiffer ..... D4/107
D392,464 S * 3/1998 Jesiolowski ..... D4/107
D395,757 S * 7/1998 Schiffer ..... D4/107
6,015,328 A * 1/2000 Glaser ..... 15/167.1
6,026,532 A * 2/2000 Catanzaro ..... 15/167.1
6,141,815 A * 11/2000 Harrison et al. ..... 15/145

OTHER PUBLICATIONS

Pictures of SALTON Inc. foot stand, stand includes a copyright mark of 1990.*
Pictures of SALTON Inc. foot stand, stand was on sale in Mar. 1999.*

* cited by examiner

*Primary Examiner*—Gary K. Graham

(57) ABSTRACT

An assembly comprising a toothbrush having a first and second end. A stand in the shape of a pair of feet retains the brush in a vertical position when the stand is placed on a horizontal surface. For additional support, a base may be incorporated with the stand.

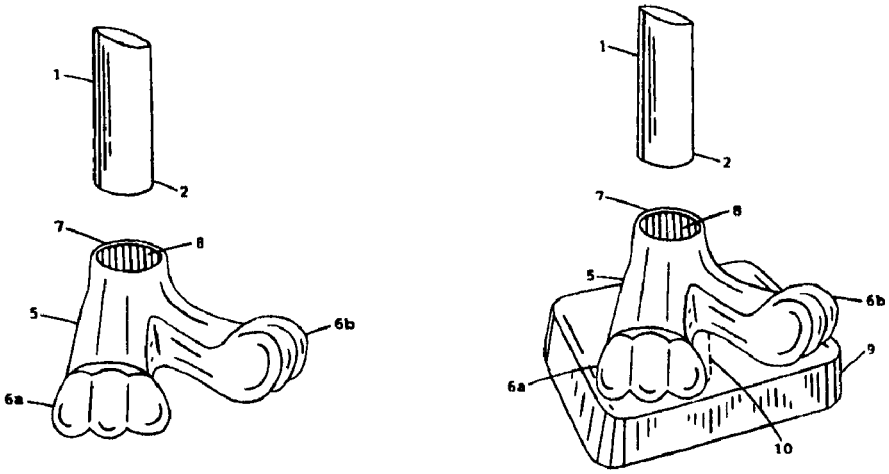

8 Claims, 1 Drawing Sheet